United States Patent [19]

Nakaoka et al.

[11] Patent Number: 4,832,762

[45] Date of Patent: May 23, 1989

[54] METHOD FOR PRODUCING THIN STEEL SHEET OF HIGH MAGNETIC PERMEABILITY

[75] Inventors: Kazuhide Nakaoka, Yokohama; Yoshikazu Takada, Kawasaki; Yasushi Tanaka, Yokohama, all of Japan

[73] Assignee: Nippon Kokan Kabushiki Kaisha, Tokyo, Japan

[21] Appl. No.: 845,873

[22] PCT Filed: Sep. 26, 1985

[86] PCT No.: PCT/JP85/00535

§ 371 Date: Mar. 3, 1986

§ 102(e) Date: Mar. 3, 1986

[87] PCT Pub. No.: WO86/02105

PCT Pub. Date: Apr. 10, 1986

[30] Foreign Application Priority Data

Sep. 28, 1984 [JP] Japan ..... 59-201597
Nov. 29, 1984 [JP] Japan ..... 59-250568

[51] Int. Cl.[4] ..... C21D 1/04

[52] U.S. Cl. ..... 148/108; 148/110; 148/113

[58] Field of Search ..... 148/16, 108, 110, 111, 148/112, 113

[56] References Cited

U.S. PATENT DOCUMENTS

| | | | |
|---|---|---|---|
| 3,224,909 | 12/1965 | Sixtus et al. | 148/16 |
| 3,423,253 | 1/1969 | Ames et al. | 148/112 |
| 3,634,148 | 1/1972 | Shin et al. | 148/112 |
| 3,912,551 | 10/1975 | Araya | 148/16 |
| 4,073,668 | 2/1978 | Wieland et al. | 148/113 |
| 4,177,092 | 12/1979 | Thursby | 148/16 |

*Primary Examiner*—John P. Sheehan
*Attorney, Agent, or Firm*—Moonray Kojima

[57] ABSTRACT

An ordinarily made thin steel sheet is placed in an atmosphere bearing $SiCl_4$, and subjecting to Si penetrating treatment at temperatures between 1100° C. and 1200° C. for a determined period of time. A heating rate is used which is more than 50° C./sec at the temperatures of more than 1000° C. in the $SiCl_4$ atmosphere.

Thereby, it is possible to manufacture thin steel sheet of high magnetic permeability without internal defects.

7 Claims, 8 Drawing Sheets

[Penetrating temperature : 1190 °C
Amount of SiCℓ4 : 16%
Diffusion treatment : 1200°C x 3hr (In inert gas)]

(Penetrating temperature : 1190°C
Heating rate : 300°C/min)

Metal structures in cross section after Si penetrating treatment

Metal structures in cross section after diffusion uniformalizing treatment

METHOD FOR PRODUCING THIN STEEL SHEET OF HIGH MAGNETIC PERMEABILITY

TECHNICAL FIELD

This invention relates to a method for producing thin steel sheets having high magnetic permeability, and more particularly, for producing thin steel sheets of high Si magnetism without internal defect by diffusing and penetrating Si into low Si thin steel sheets.

BACKGROUND OF THE INVENTION

In Fe-Si alloy and Fe-Si-Al alloy, there are Fe-6.5%Si alloy and Fe-9.6%Si-5.4%Al alloy (sendust) which have very high magnetic permeability and excellent soft magnetic characteristics. Especially, the sendust has been applied to electronic instrumentalities such as dust cores, magnetic heads and others since its invention in 1973. With respect to the magnetic head, a high coercive field strength of recording media has advanced nowadays, accompanying high density of magnetic recording media, and the sendust of high saturated magnetization has been interested, since this material is more suitable to the recoding than ferrite head used conventionally. Since Fe-6.5%Si alloy has high saturation flux density, this material is considered to be applied to iron cores of transformers, or other electric, and electronic instrumentalities.

A problem when these high Si alloys which are excellent in the soft magnetic characteristics are used for electronic parts, is that they could not be rolled in thin shape, since they are brittle. Therefore, the sendust is sliced after forging to produce thin pieces for the magnetic heads, which is, however, a process very inferior in efficiency in the production of the heads. Besides, the sendust is easily formed with cracks or pinholes during solidification after casting, and those defects should be removed for which, however, a further process is required.

For solving the problems involved with the above mentioned manufacturing process, the under mentioned processes have been proposed.

(1) Rolling and deforming in hot work (2) Improvement of workability by addition of elements (3) Direct production by rapid solidification (4) Composition control after rolling The above mentioned process (1) is made possible by super slow strain rate at the temperature of more than 1000° C., however it would invite much difficulties in practising such a condition industrially. The attempt (2) more or less improves the workability by adding the elements, but the material is brittle, and an application to the thin sheet is difficult and the added elements deteriorates the magnetism. The process (3) directly casts the molten metal into the thin shape, and is very useful to the brittle material in regard to production of the thin sheets without the rolling process. The control (4) comprises, melting low Si or low Al steel, rolling it in thin shape, enriching Si or Al by penetration from the surface thereof, and finally producing high Si thin steel sheets.

However, since conventionally proposed penetrating processes take penetration treating time as long as more than 30 minutes and temperatures as high as about 1230° C., the shapes after the penetrating treatment are undesirable. Further, the most fatal phenomenon in the prior art to the production of the high magnetic permeable materials is generation of large voids called Kirkendall void which accompany the penetration. These voids remain in spite of the sintering treatment, so that the magnetic permeability is considerably declined. The reason why a process of producing high Si thin steel sheet by the Si penetration has not yet been realized, is that it is difficult to remove the voids.

DISCLOSURE OF THE INVENTION

The present invention has been realized to improve shortcomings of the conventional techniques, and is to provide a producing method, where a composition control process after rolling is improved for providing a desired content of Si in a short period of time and preventing generation of voids.

The inventors studied in detail the Si penetrating conditions in the prior art, and found a condition which accelerated the Si penetrating speed, and did not allow voids residual after the Si penetrating treatment and the diffusion treatment. The desired Si content was accomplished by the Si penetrating treatment, and subsequently thin sheets of high Si having very high magnetic permeability were produced.

The inventors made tests and studies, and found the best range where the voids were not generated with regard to the heating rate and the Si penetrating temperatures in the atmosphere bearing $SiCl_4$, and further found the best range with respect to partial pressure of Si compounds in the atmosphere.

In the invention, thin steel sheets (thickness: 10 mm to 10 μm) are at first produced through an ordinary process. Kinds of magnetic thin sheets of high magnetic permeability available for the invention include 3–6.5-%Si-Fe alloy and sendust alloy, and it is preferable to determine as mentioned under the composition of the thin steel sheets for Si penetration.

(1) In a case of 3–6.5%Si-Fe alloy C: not more than 0.01%; Si: 0–4.0%; Mn: not more than 2%; and unavoidable impurities being preferably as little as possible (2) In a case of sendust alloy C: not more than 0.01%; Si: not more than 4%; Al: 3–8% Ni: not more than 4%; Mn: not more than 2%; elements increasing corrosion resistance such as Cr, Ti and others: not more than 5%; and unavoidable impurities being preferably as little as possible.

These thin steel sheets are placed in the atmosphere bearing $SiCl_4$ for penetrating treatment. This treating condition is, in the invention, limited to the Si penetrating temperatures between 1100° C. and 1200° C. (temperature of the sheet). FIG. 1 shows the relationship between the Si penetrating temperature and the number of generating voids. As is seen from the graph, the number of the voids is almost zero above 1100° C. after a diffusion treatment (later mentioned). Therefore, the lower limit is 1100° C. On the other hand, $Fe_3Si$ to be formed in the Si penetrating layer will be molten away above 1200° C., and this temperature is an upper limit. High temperature as possible is advantageous for preventing the voids.

With respect to the number in the voids of the graph in FIG. 1, the cross section of the test piece having thickness of 0.4 mm was measured over the width of 2.4 mm, and the void number was counted (same also in FIGS. 2 and 5).

The invention limits the heating rate to more than 50° C./min, coming to said penetrating temperatures in the $SiCl_4$ atmosphere at the temperature of more than 1000°

C. The reason for limiting the heating rate is for avoiding generation of Kirkendall voids by the Si penetration at the temperature between 1000° C. and the determined temperature during heating. FIG. 2 shows the relationship between said heating rate and the void number. The higher is the heating rate, the more the void number decreases, and since the voids almost fade away, this rate is determined as the lower limit.

The heating rate is, to the end, in the $SiCl_4$ atmosphere at the temperature of more than 1000° C., and various are available for providing the heating rate of more than 50° C./min.

For example, the most ordinary manner is to place the thin steel sheet made by the ordinary process as at the room temperature into the heating furnace of the $SiCl_4$ atmosphere, and heat it to the determined penetrating temperature.

If it is difficult to obtain the heating rate of more than 50° C./min by the above mentioned manner, it is possible that the thin steel sheet be heated in advance to the set temperature of 1100° to 1200° C. in the furnace of an inert gas atmosphere, and $SiCl_4$ steam is introduced into the furnace. In this case, since the heating is not performed in the atmosphere of $SiCl_4$ at the temperature between more than 1000° C. and not more than 1100° C., the heating rate can be made infinite.

A compromise manner thereof may be assumed variously as preheating the thin steel sheet more than 1000° C., introducing it in the heating furnace of the atmosphere of $SiCl_4$, and heating to the set temperature.

When the steel sheet is preheated, oxidation should be avoided as possible as much could. Because the oxidation of the thin steel accelerates forming of Fe-Si oxides of low melting point during Si penetration, the objects of the invention would tend to be frustrated.

When the Fe-5.5%Al thin steels (thickness: 0.40 mm) were undertaken with the Si penetrating treatment in the $SiCl_4$ atmosphere at the temperature of 1190° C. for 30 minutes, the heating rates up to 1190° C. from 1000° C. were 10° C./min, 50° C./min and 300° C./min, respectively. FIG. 3 shows respective structures in cross section after Si penetration. Apparently, it is seen that the generation of the voids (black part in centers of the photograph) is prevented at the higher heating rate.

The inventors, through many tests and studies, found that the partial pressure of Si compound was large factors concerning the speed of Si penetration from the outer atmosphere, and the higher is the partial pressure of Si compound, the faster is the speed of the Si penetration, while the higher is the partial pressure, the more increases in the void number, on the other hand.

Fe-5.4%Al steels were treated in the $SiCl_4$ atmosphere, and FIG. 4 shows weight changes of the thin steels when the amounts of $SiCl_4$ in the introduced gas were changed 10%, 16% and 55% for changing the partial pressure of $SiCl_4$. The weight change is a parameter which shows the degree of the Si penetration, according to which the larger is the weight change, the more is the Si penetration. This phenomenon is assumed to depend upon the reaction of $5Fe+SiCl_4 \rightarrow Fe_3Si+2FeCl_2$ where $FeCl_2$ is out of the solid. It is seen from FIG. 4 that the higher is Si partial pressure, the faster is the speed of Si penetration.

However, with respect to the void amount, it is recognized that when Si partial pressure becomes higher, the void amount increases. FIG. 5 is the relationship between the amount of $SiCl_4$ and the amount of void after the Si penetration treatment and the diffusion treatment, and clearly shows that when Si partial pressure becomes higher, the void amount increases.

This reason is not clear, but would be assumed as follows. When the amount of $SiCl_4$ in the introducing gas is made less, the amount of Si decreases which penetrates from the outside per the unit time and the unit surface area, and this fact shows that the amount of Si atom also decreases which penetrates into the interior through Kirkendall surface, and porosities, that is, generation of Kirkendall voids decreases. Under such circumstances, since the diffusion of Fe and Si atoms which are caused by thermal activity of test pieces, progress in order together with the Si penetration, said diffusions are easily absorbed or extinguished by dislocations or the like in the interior, before the generated Kirkendall voids gather and turn out stable voids. Therefore, if the Si penetrating speed is lowered, the voids are prevented from occurring as residue.

The inventors studied the Si partial pressure and the magnetic permeable characteristics of the products and found that, as shown in FIG. 6, the less is the amount of $SiCl_4$, the lower is the coercive field strength.

By this finding, it is preferable that the amount of $SiCl_4$ in the atmosphere be not more than 25%. That is, as seen from FIG. 5, the voids are not generated when $SiCl_4$ is less than 25%. FIG. 6 shows that the lowering of the coercive field strength is saturated at less than 25% $SiCl_4$. From these two viewpoints, it is preferable to limit the amount of $SiCl_4$ to not more than 25% in the atmosphere of Si penetrating treatment.

A limitation is not especially made to the time of Si penetrating treatment, and it may be appropriately determined in view of the amount of Si in the product, Si content in the atmosphere bearing $SiCl_4$, the penetration treating temperature, Si content in the starting steel sheet, and others.

After Si has been penetrated at a desired amount by the above treatment, the chemical elements are uniformalized by the diffusion treatment. The diffusion treatment may be continuously carried out by switching the atmosphere to an inert gas, instead of cooling the base sheet, otherwise it may be done after the base sheet has been once cooled to the room temperature.

When the base sheet is once cooled to the room temperature, the cooling should be carried out in the inert atmosphere or in the $SiCl_4$ atmosphere for avoiding oxidation. When cooling in the $SiCl_4$ atmosphere, it is necessary to shorten the passing time of the temperature range of more than 1000° C. (especially 1000° to 1100° C.), as similarly in the heating, for controlling the generation of the voids, and the cooling rate at the temperature of more than 1000° C. should be more than 50° C./min.

The diffusion treatment is carried out at a determined temperature in relation to the treating time, and it is done in the inert atmosphere for avoiding oxidation. The diffusion treating time is appropriately selected in response to treating temperature, thickness and Si content of an objective product.

If the material produced by the invention shows effect of magnetic annealing (e.g., Fe-6.5%Si, or Fe-Si-Al-Ni alloys), the soft magnetism may be improved by exciting the magnetic field in the course of cooling during the diffusion treatment. This manner has an advantage in that the heating treatment is performed at the same temperature as the diffusion treatment without requiring an independent heating treatment with respect to the cooling in the magnetic field, thereby to improve the magnetism. A condition of cooling in the magnetic field is to cool the magnetic field of more than 1 G at the cooling rate of not more than 30° C./sec from the temperature of more than 800° C. The cooling effect of the magnetic field could not be expected outside of the range.

THE MOST PREFERABLE EMBODIMENT FOR REDUCING THE INVENTION TO PRACTICE

EXAMPLE 1

Alloy of the chemical composition shown below was subjected to the hot and cold rollings so as to produce a thin sheet of 0.40 mm thickness as a base sheet.

TABLE 1

| C | Si | Mn | P | S | Al | N | (wt %) Fe |
|---|---|---|---|---|---|---|---|
| 0.004 | 0.01 | Trace | 0.001 | 0.0006 | 5.37 | 0.0009 | Balance |

Figure 1:
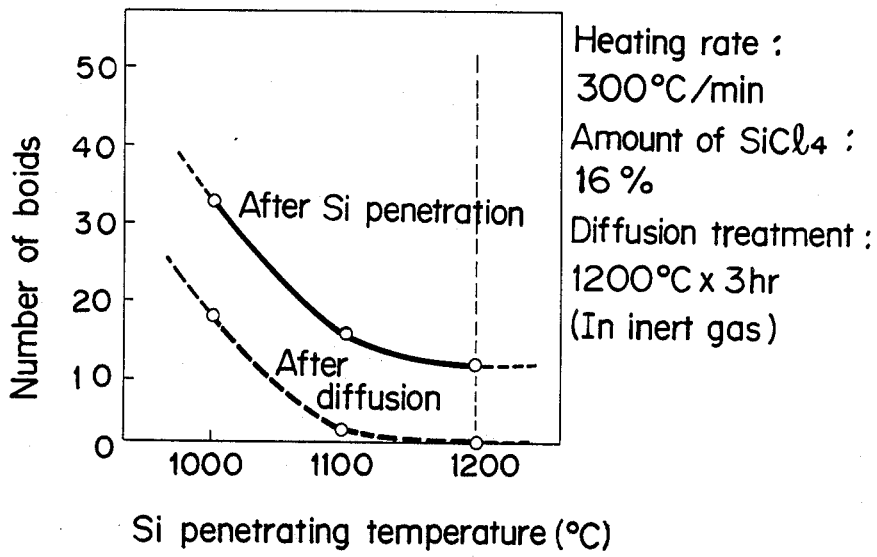
FIG. 1 is a graph showing the relationship between Si penetrating temperature and the number of voids.
Figure 2:
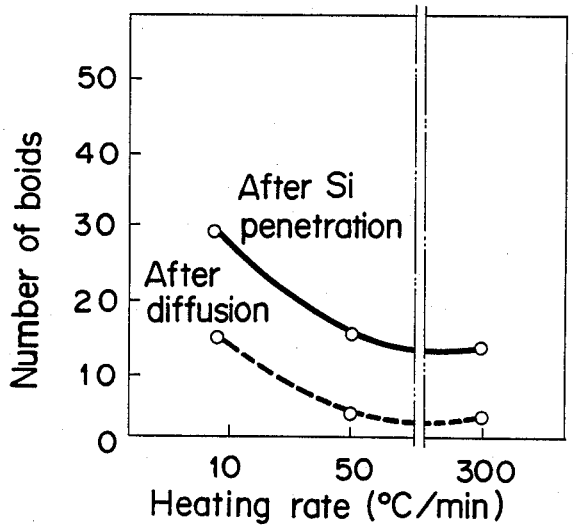
FIG. 2 is a graph showing the relationship between the heating rate and the number of voids.
Figure 3:
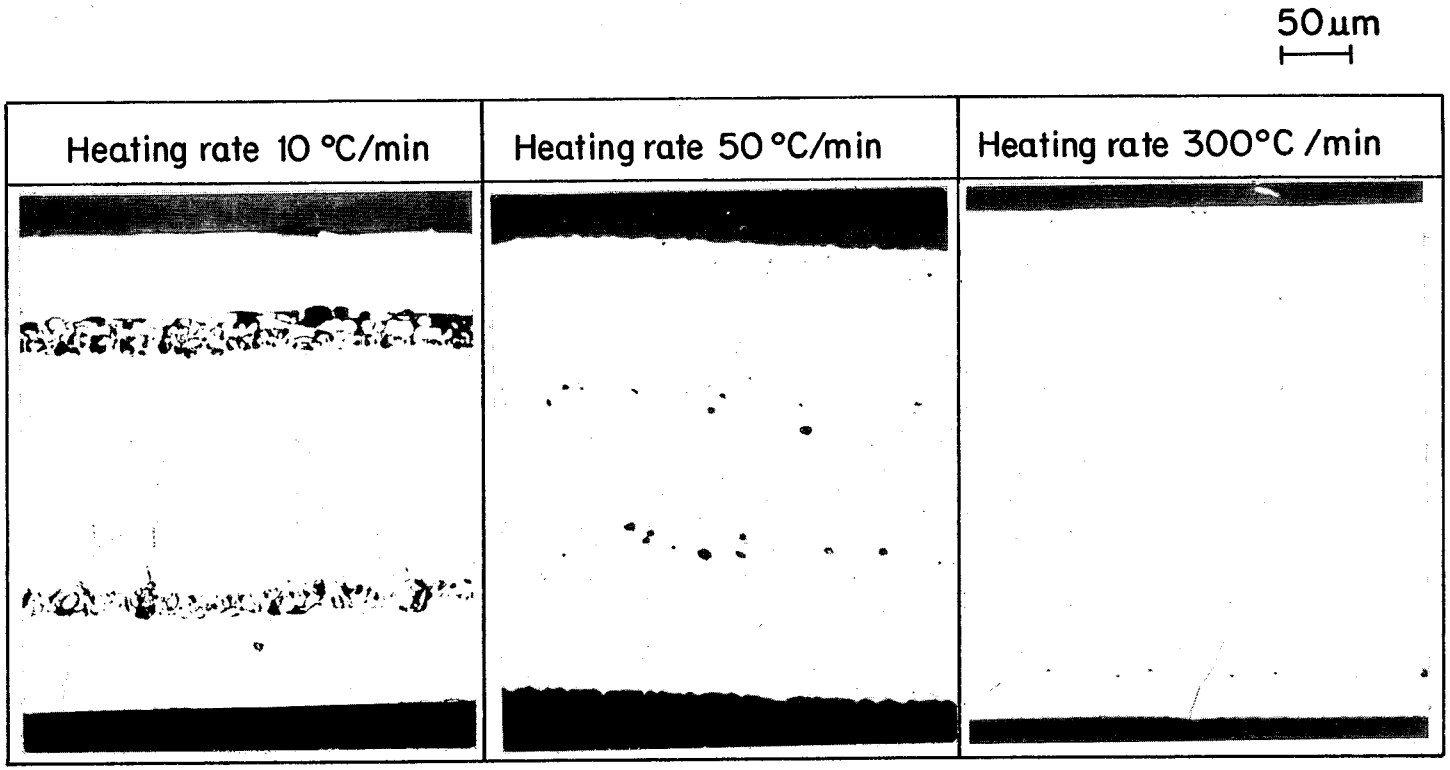
FIG. 3 is microscopic photographs of metal structures in cross section, showing differences in generation of the voids by the cooling rates.
Figure 4:
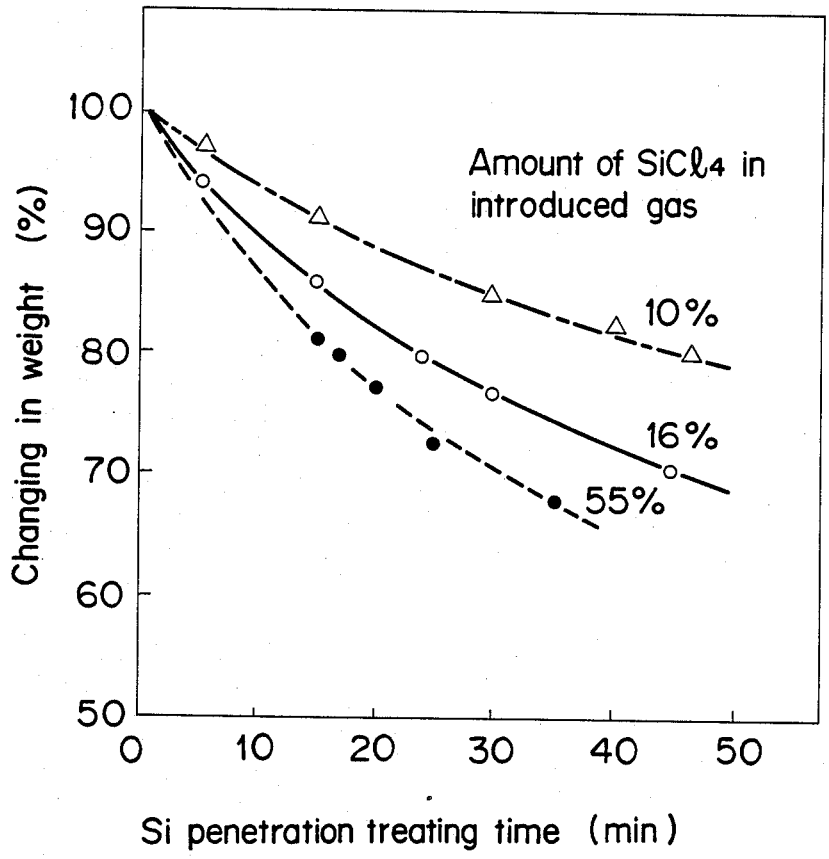
FIG. 4 is a graph showing the relationship between time for Si penetrating treatment and weight change of the steel sheet, where the amount of $SiCl_4$ is a parameter.
Figure 5:
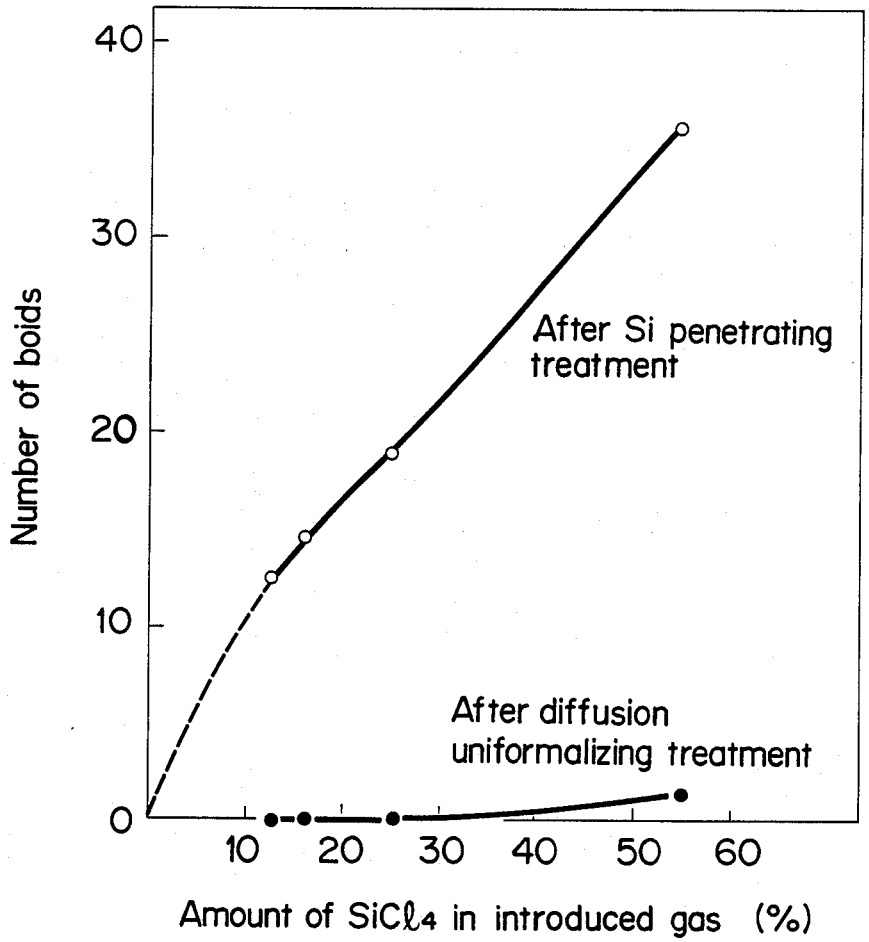
FIG. 5 is a graph showing the relationship between the amount of $SiCl_4$ and the number of the voids.
Figure 6:
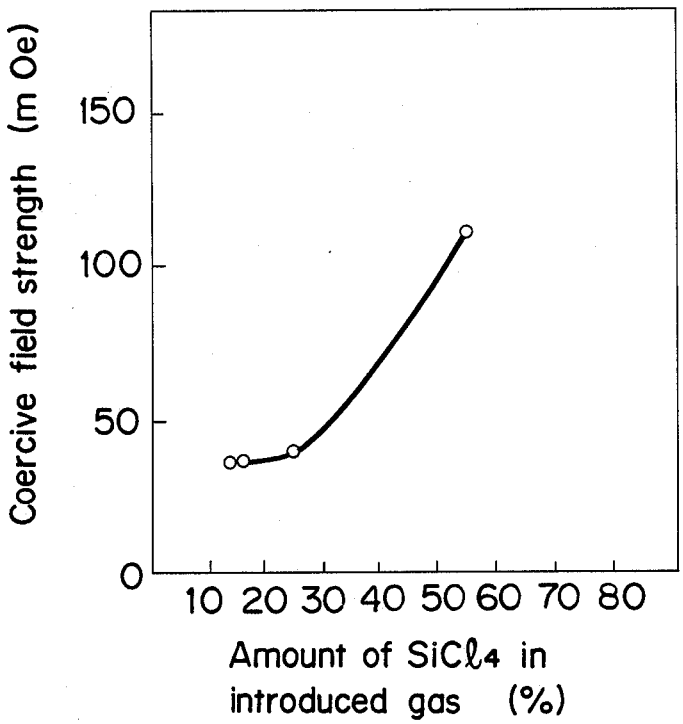
FIG. 6 is a graph showing the relationship between the amount of $SiCl_4$ and the coercive force.
Figure 7:
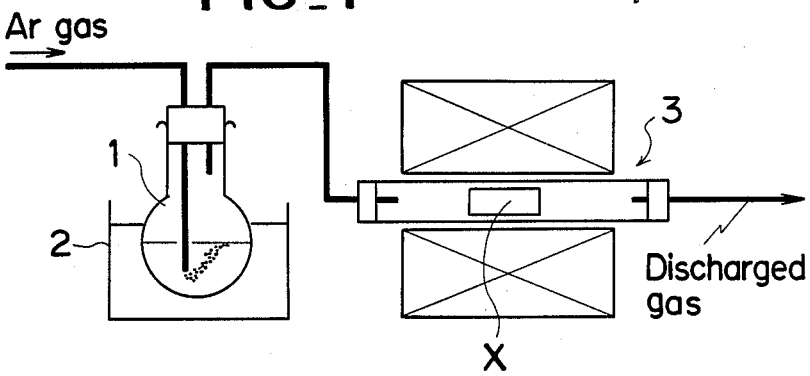
FIG. 7 is an arrangement for practising the invention.

This base sheet was performed with Si penetrating treatment through the device shown in FIG. 7, where the numeral 1 is a round bottom flask filled with $SiCl_4$, the numeral 2 is a thermostat bath, 3 is a furnace, and (X) is a test piece.

TABLE 2

| Test pieces | $SiCl_4$(%) in intro. gas | Penetration treatment conditions | Heating rate (°C./min) | Cooling rate (°C./min) |
|---|---|---|---|---|
| A | 13 | 1190° C. × 30 min. | 300 | 300 |
| B | 16 | 1190° C. × 25 min. | " | " |
| C | 25 | 1190° C. × 18 min. | " | " |
| D | 55 | 1190° C. × 15 min. | " | " |

$SiCl_4$ in the introducing gas was changed by controlling the temperature of the thermostat bath 2 of a $SiCl_4$ vaporizer. The conditions of the penetrating treatment each depended upon the conditions where Si penetrated up to 9.6%.

The furnace 3 for the Si penetrating treatment had a heating element of silicon carbide. A core tube of the furnace was made of ceramics and 40 mm in inner diameter. A carrier gas of $SiCl_4$ was Ar and its flow amount was 0.5 l/min.

When the test pieces subjected to the Si penetrating treatment were chemically analyzed, it was found that each of them contained the objective Si content (9.6%).

Figure 8:
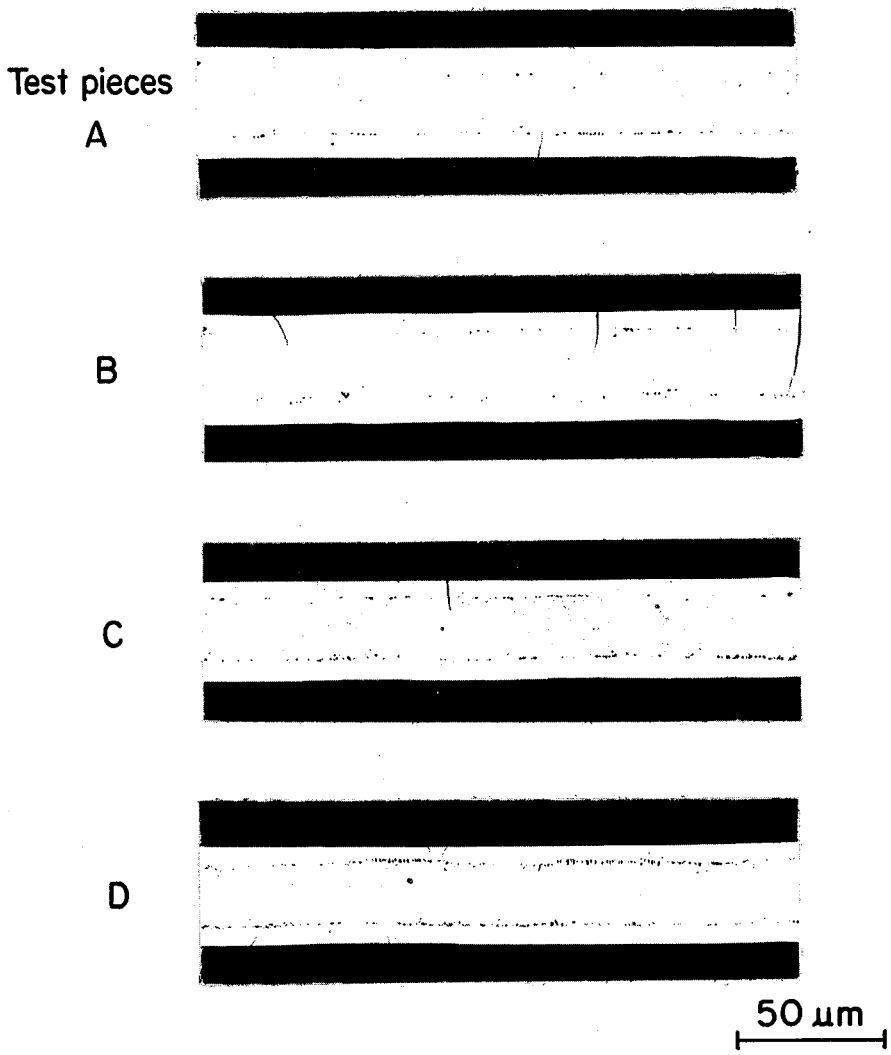
FIGS. 8 and 9 are microscopic photographs of metal structures in cross section.
Figure 9:
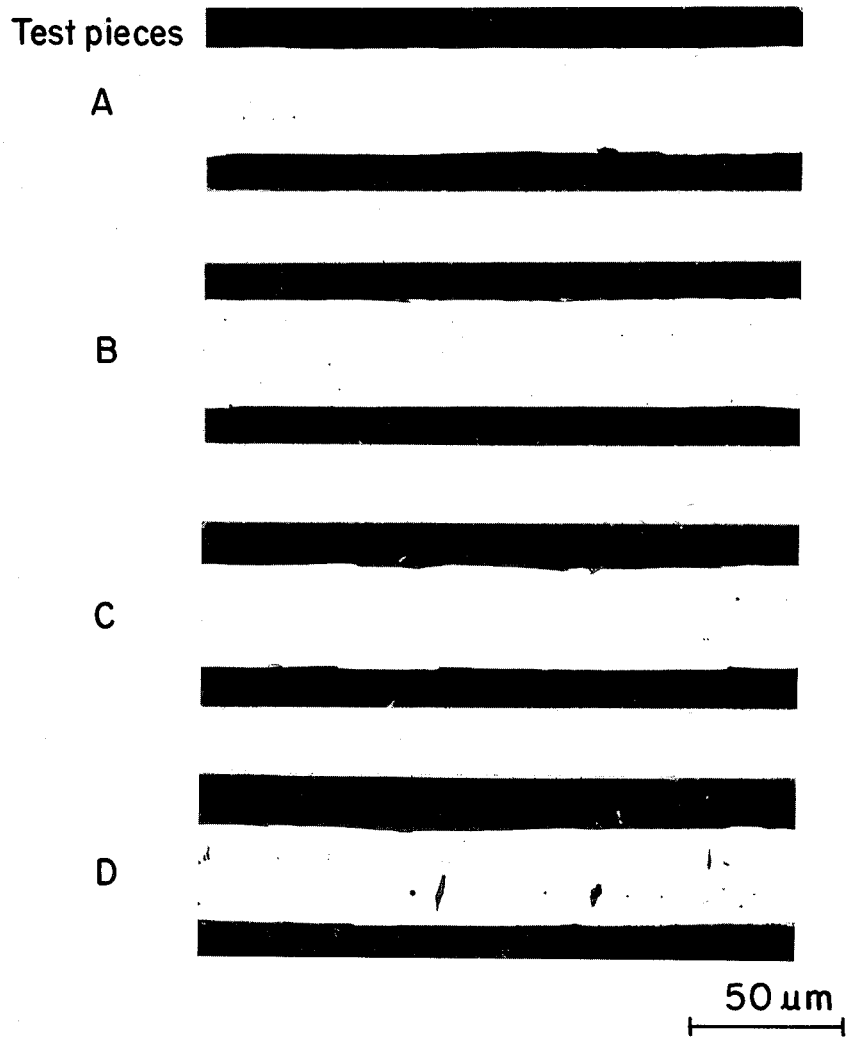

FIGS. 8 and 9 are photographs of structure in cross section of the test pieces A to D after Si penetrating treatment and after the diffusion treatment in the inert atmosphere at the temperature of 1200° C. for one hour. It is seen that the more is $SiCl_4$ in the introducing gas, the more distinguished is the generation of the voids after Si penetrating treatment as well as after the diffusion treatment.

In the structures after the diffusion treatment, the test piece D has large and many residual voids, while the test pieces A to C show very few voids.

EXAMPLE 2

Fe-6.5%Si thin steel sheet was produced from the base sheet (thickness: 0.4 mm) of the under shown chemical composition.

TABLE 3

| C | Si | Mn | P | S | Al | N | (wt %) Fe |
|---|---|---|---|---|---|---|---|
| 0.005 | 2.91 | 0.04 | 0.002 | 0.0007 | 0.043 | 0.0016 | Balance |

The penetrating treatments were performed by variously changing the conditions as under.

TABLE 4

| | Test pieces | $SiCl_4$(%) | Penetrating treatment | Heating rate (°C./min) |
|---|---|---|---|---|
| Invention | A | 25 | 1190° C. × 6 min | 300 |
| | B | 16 | 1190° C. × 7 min | " |
| Com- | C | 55 | 1190° C. × 3 min | " |
| parison | D | 25 | 1050° C. × 30 min | " |

Subsequently to these test pieces, the test pieces were undertaken with the diffusion treatment of 1200° C.×3 hr in the Ar flow, and thereafter formed into rings of 10 mm inner diameter and 20 mm outer diameter by an electric discharging process, and coiled with 30 turns of a primary windings and 40 turns of a secondary windings for carrying out DC magnetism measurement. The results are shown in Table 5.

TABLE 5

| Test pieces | Coercive field strength | Maximum permeability | Flux density (G at 10 Oe) |
|---|---|---|---|
| A | 140 | 17000 | 13000 |
| B | 120 | 18000 | 13000 |
| C | 200 | 8000 | 10000 |
| D | 280 | 6600 | 9500 |

From the above, it is seen that the test pieces A and B show the magnetic characteristics more satisfactory than the test pieces C and D of the comparative processes.

EXAMPLE 3

The base sheet of Fe-3%Si thin steel of the same chemical composition as EXAMPLE 2 were undertaken with the Si penetrating treatment and the diffusion treatment under the following conditions for producing Fe-6.5%Si thin sheet.

$SiCl_4$: 25%

Penetration treating condition: 1190° C.×6 min

Heating rate: 300° C./min

Diffusion treatment: 1200° C.×3 hr in Ar

Cooling conditions: Cooling from not more than 1200° C. to 800° C. at 50° C./min and cooling from not more than 800° C. to the following 10° C./min by the DC magnetic field of 80e.

When the magnetic characteristics were measured in the above treated materials, they showed preferable values of the maximum magnetic permeability of 38000.

EXAMPLE 4

Fe-6.5%Si thin steels were produced from Si steel of grain oriented property (thickness: 0.30 mm) prepared by GOSS process. The chemical composition of the steel and the Si penetrating treatment conditions are shown in Tables 6 and 7.

TABLE 6

| C | Si | Mn | P | S | Al | N | Fe |
|---|---|---|---|---|---|---|---|
| 0.0026 | 3.10 | 0.05 | 0.021 | 0.0004 | 0.001 | 0.0007 | Balance |

TABLE 7

| Test Pieces | $SiCl_4$ (%) | Penetrating treatment | Heating rate (°C./min) | Remarks |
|---|---|---|---|---|
| 1-16 | 16 | 1190° C. × 7 min | 300 | Invention |
| 17-26 | 55 | 1190° C. × 3 min | " | Invention |
| 27, 28 | 0 | 1190° C. × 7 min | " | Non-treatment |

Figure 10:
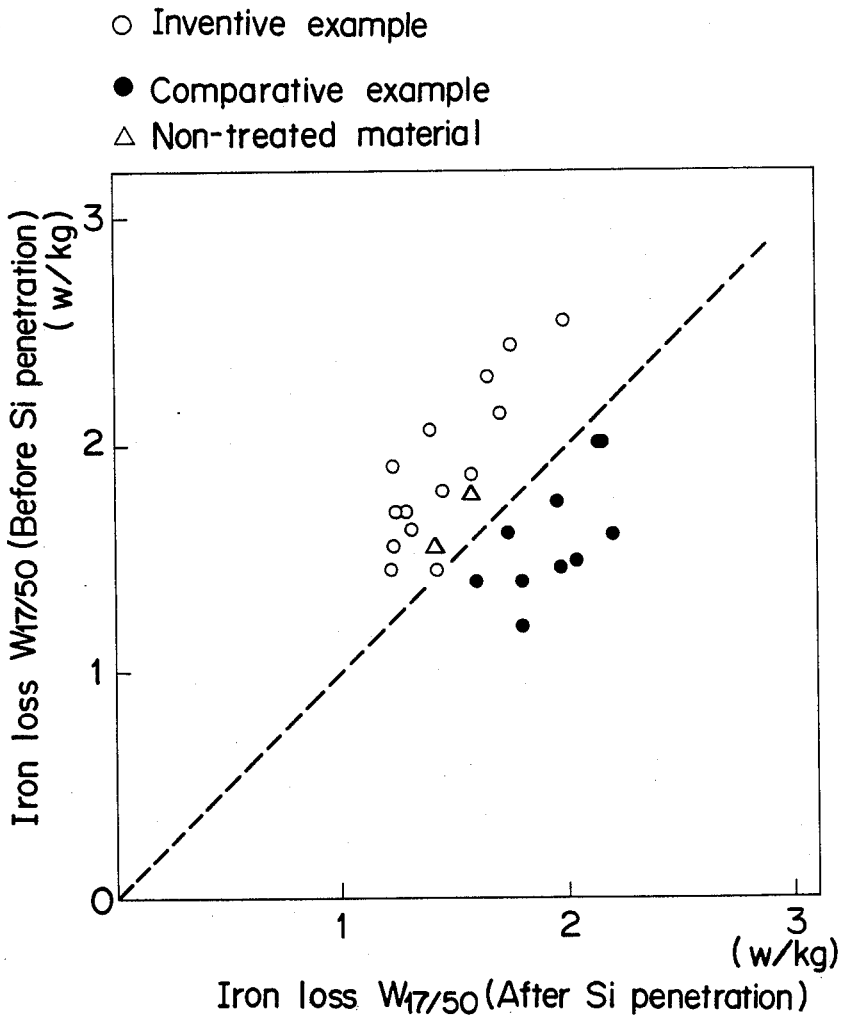
FIG. 10 is a graph showing iron loss W17/50 before and after the penetrating treatment.

Subsequently to each of the test pieces, the test pieces were undertaken with the diffusion treatment of 1200° C.×2 hr in Ar flow, and iron loss was sought at ignition of 50 Hz and 17 KG by a single magnetic tester. FIG. 10 shows iron loss value W17/50 before and after the penetrating treatments. The test pieces by the invention show satisfactory magnetic characteristics than the comparative examples.

What is claimed is:

1. In a method for producing thin steel sheet of high magnetic permeability, comprising the steps of placing a thin steel sheet in an atmosphere bearing $SiCl_4$, causing Si to penetrate into said steel sheet at a siliconizing temperature of between 1100° C. and 1200° C. during said penetration, and carrying out a diffusion treatment on said steel sheet in an inert atmosphere, the improvement comprising the step of heating the steel sheet at a heating rate of more than 50° C./min. from a temperature of more than 1000° C. to said siliconizing temperature in the atmosphere bearing $SiCl_4$ so as to avoid occurrence of voids in said steel sheet.

2. A method as claimed in claim 1, wherein the amount of $SiCl_4$ is not more than 25 vol% in the $SiCl_4$ bearing atmosphere.

3. A method as claimed in claim 1, performing the Si penetrating treatment, cooling the thin steel in an inert atmosphere, and carrying out a diffusion treatment at a determined temperature in the inert atmosphere.

4. A method as claimed in claim 1, placing the thin steel in the inert atmosphere just after the Si penetrating treatment.

5. A method as claimed in claim 1, performing the Si penetrating treatment, cooling the thin steel in the $SiCl_4$ bearing atmosphere at a cooling rate of more than 50° C./min at the temperature of more than 1000° C., and carrying out a diffusion treatment at a determined temperature in the inert atmosphere.

6. A method as claimed in claim 1, cooling the thin steel in a magnetic field in the diffusion treatment.

7. A method as claimed in claim 1, cooling the thin steel in the magnetic field of more than 1 G at the cooling rate of more than 30° C./sec from the temperature of more than 800° C.

* * * * *